US011336038B2

(12) United States Patent
Gribby

(10) Patent No.: US 11,336,038 B2
(45) Date of Patent: May 17, 2022

(54) ARRANGEMENT FOR A COAXIAL CABLE CONNECTOR

(71) Applicant: Teleste Oyj, Littoinen (FI)

(72) Inventor: Steve Gribby, Hampshire (GB)

(73) Assignee: Teleste Oyj, Littoinen (FI)

( * ) Notice: Subject to any disclaimer, the term of this patent is extended or adjusted under 35 U.S.C. 154(b) by 0 days.

(21) Appl. No.: 17/280,712

(22) PCT Filed: Sep. 28, 2018

(86) PCT No.: PCT/FI2018/050700
§ 371 (c)(1),
(2) Date: Mar. 26, 2021

(87) PCT Pub. No.: WO2020/065122
PCT Pub. Date: Apr. 2, 2020

(65) Prior Publication Data
US 2021/0313715 A1 Oct. 7, 2021

(51) Int. Cl.
*H01R 9/05* (2006.01)
*H01R 4/70* (2006.01)

(52) U.S. Cl.
CPC ..... *H01R 9/0524* (2013.01); *H01R 4/70* (2013.01); *H01R 9/0521* (2013.01)

(58) Field of Classification Search
CPC ..... H01R 9/0524; H01R 9/0521; H01R 4/70; H01R 9/05; H01R 9/0518; H01R 13/59; H01R 24/38
See application file for complete search history.

(56) References Cited

U.S. PATENT DOCUMENTS 4,902,246 A 2/1990 Samchisen
7,179,122 B2 * 2/2007 Holliday ..... H01R 9/0518 439/578

(Continued)

FOREIGN PATENT DOCUMENTS

WO 2017/098084 6/2017

OTHER PUBLICATIONS

Written Opinion of the International Preliminary Examining Authority from PCT Application No. PCT/FI2018/050700 dated Sep. 16, 2020, 8 pages.

(Continued)

*Primary Examiner* — Travis S Chambers
(74) *Attorney, Agent, or Firm* — Mueting Raasch Group

(57) ABSTRACT

A connector suitable for being mounted on a coaxial cable comprising at least one metal braid layer surrounding inner parts of the cable and an outer insulating layer surrounding said at least one metal braid layer and a silicone sleeve arranged around the outer insulating layer wherein the connector comprises a ferrule to be arranged in electrical contact with said at least one metal braid layer, wherein said outer insulating layer of the cable is arranged to be stripped away for the length of said electrical contact, a base arranged cylindrically around said ferrule, and a collar arranged at least partially within said base and comprising a body configurable around the ferrule; wherein the body of the collar has a first outer diameter substantially the same as the diameter of the outer insulating layer of the coaxial cable; and the silicone sleeve is arranged, upon mounting the coaxial cable to the connector, between the base and the body of the collar for applying a pressure force to said at least one metal braid layer of the coaxial cable guided to an outer surface of the collar.

5 Claims, 3 Drawing Sheets

(56) References Cited

U.S. PATENT DOCUMENTS

| | | | | |
|---|---|---|---|---|
| 8,834,200 | B2 * | 9/2014 | Shaw | H01R 13/46 439/578 |
| 10,530,074 | B2 * | 1/2020 | Mothersdale | H01R 9/0524 |
| 10,784,598 | B2 * | 9/2020 | Mothersdale | H01R 9/0524 |
| 10,892,571 | B2 * | 1/2021 | Mothersdale | H01R 4/62 |
| 2005/0164553 | A1 * | 7/2005 | Montena | H01R 9/0518 439/578 |
| 2005/0181652 | A1 | 8/2005 | Montena et al. | |
| 2013/0337683 | A1 * | 12/2013 | Chastain | H01R 9/0521 439/578 |
| 2014/0106614 | A1 * | 4/2014 | Burris | H01R 24/40 439/578 |
| 2015/0162675 | A1 * | 6/2015 | Davidson, Jr | H01R 13/5202 439/583 |
| 2016/0248178 | A1 * | 8/2016 | Hammons | H01R 9/0524 |

OTHER PUBLICATIONS

Written Opinion of the International Searching Authority from PCT Application No. PCT/FI2018/050700 dated May 22, 2019, 10 pages.

International Preliminary Report on Patentability from PCT Application No. PCT/FI2018/050700 dated Nov. 17, 2020, 12 pages.

* cited by examiner

ARRANGEMENT FOR A COAXIAL CABLE CONNECTOR

FIELD OF THE INVENTION

The present invention relates to television network installations and more particularly to an arrangement for a coaxial cable connector.

BACKGROUND OF THE INVENTION

F type connectors, specified in the standard IEC 60169-24, have been used for decades for terrestrial, cable, and satellite TV installations. The male F connector body is typically crimped or compressed onto the exposed outer braid of the coaxial cable. Female F Type connectors have an external thread to which male connectors having a matching internally threaded connecting ring are connected by screwing. In various TV installations, it is vital that the metal-to-metal contact resistance between the connector and the cable braiding is optimised and maintained over time for good contact resistance. Any degradation in overall contact resistance will result in increasing the transfer impedance and will degrade the screening effectiveness.

It has turned out that while a cable interconnect assembly using such connectors may meet the Class A++ CENELEC standard requirements when manufactured, the coupling transfer function of practically all assemblies has degraded significantly after having been installed in a CATV network some time.

WO 2017/098084 revealed that this was caused by generation of Common Path Distortion (CPD), which was influenced by damages of the metal braid layer and oxidising of the aluminium braiding. WO 2017/098084 also provided a very effective solution for solving the problem; namely, a silicone sleeve arranged around the metal braid layer for applying pressure such that the metal braid layer is pressed tightly against the ferrule of the connector. The silicone sleeve enables to maintain metal-to-metal contact resistance force, thereby preventing the aluminium cable creep and the oxidising of the aluminium braiding.

However, while being very effective in terms of preventing the damages of the metal braid layer and oxidising of the aluminium braiding, the installation of the silicone sleeve around the metal braid layer after removing an outer plastic jacket has faced some challenges. For example, for facilitating the installation of the connector in field by technicians, it would be helpful to pre-install the silicone sleeve around the coaxial cable, i.e. over the outer jacket of the cable. However, removing the outer jacket of cable upon installation reduces the diameter of the cable such that achieving sufficient pressure with a pre-installed sleeve may become difficult.

Consequently, there is a need for an improved arrangement for connecting a coaxial cable to a connector.

SUMMARY OF THE INVENTION

Now an improved arrangement has been developed to alleviate the above-mentioned problems. As an aspect of the invention, there is provided an arrangement for connecting a coaxial cable to a connector, which is characterized in what will be presented in the independent claim. The dependent claims disclose advantageous embodiments of the invention.

According to a first aspect, there is provided a connector suitable for being mounted on a coaxial cable comprising at least one metal braid layer surrounding inner parts of the cable and an outer insulating layer surrounding said at least one metal braid layer and a silicone sleeve arranged around the outer insulating layer; wherein the connector comprises a ferrule to be arranged in electrical contact with said at least one metal braid layer, wherein said outer insulating layer of the cable is arranged to be stripped away for the length of said electrical contact, a base arranged cylindrically around said ferrule, and a collar arranged at least partially within said base and comprising a body configurable around the ferrule; wherein the body of the collar has a first outer diameter substantially the same as the diameter of the outer insulating layer of the coaxial cable; and the silicone sleeve is arranged, upon mounting the coaxial cable to the connector, between the base and the body of the collar for applying a pressure force to said at least one metal braid layer of the coaxial cable guided to an outer surface of the collar.

According to an embodiment, the body of the collar has a second outer diameter larger than the diameter of the outer insulating layer of the coaxial cable.

According to an embodiment, the silicone sleeve is arranged within said connector in a position co-locating with the contact area of the braiding and the ferrule.

According to an embodiment, the silicone sleeve is arranged within said connector in a position where sleeve also cover a part of the coaxial cable.

According to an embodiment, a front end of the silicone sleeve is provided with an edge extending inwards.

According to a second aspect, there is provided a collar for a ferrule of a coaxial cable connector, the collar comprising a body configurable within a base of the connector and around a ferrule of the connector, wherein the body of the collar has an outer diameter substantially the same as the diameter of an outer insulating layer of the coaxial cable.

These and other aspects of the invention and the embodiments related thereto will become apparent in view of the detailed disclosure of the embodiments further below.

LIST OF DRAWINGS

In the following, various embodiments of the invention will be described in more detail with reference to the appended drawings, in which FIG. 1 an example of the structure of a coaxial cable;

Figure 4A:
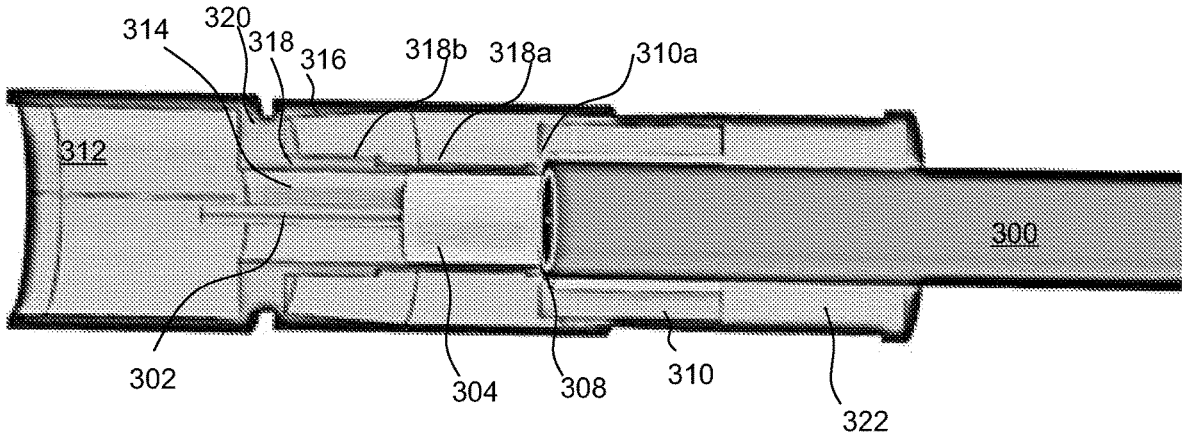
Figure 4B:
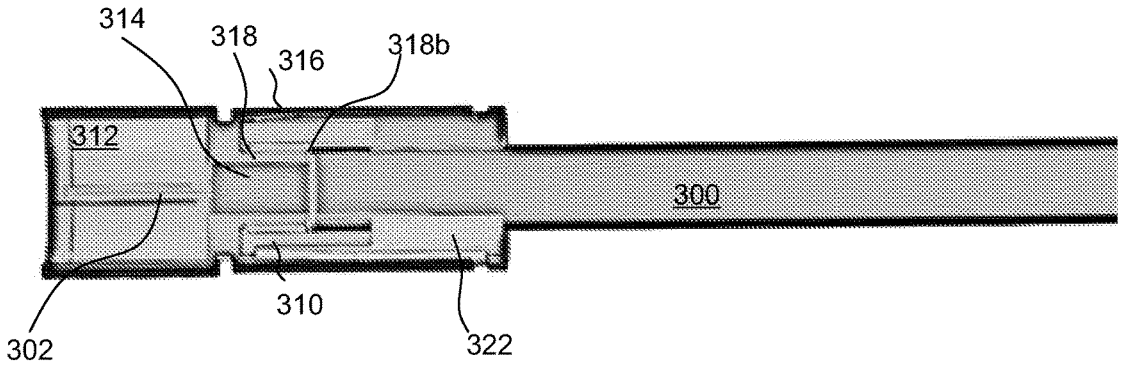
Figure 5:
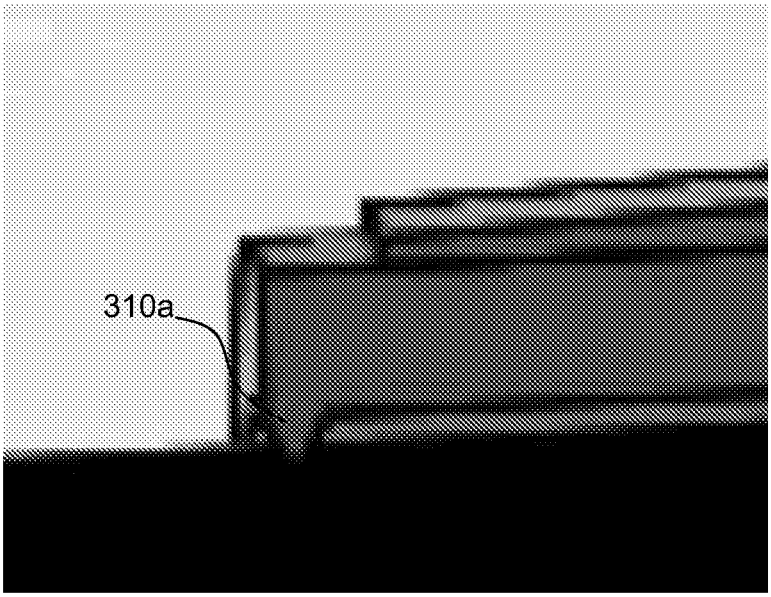
Figure 6:
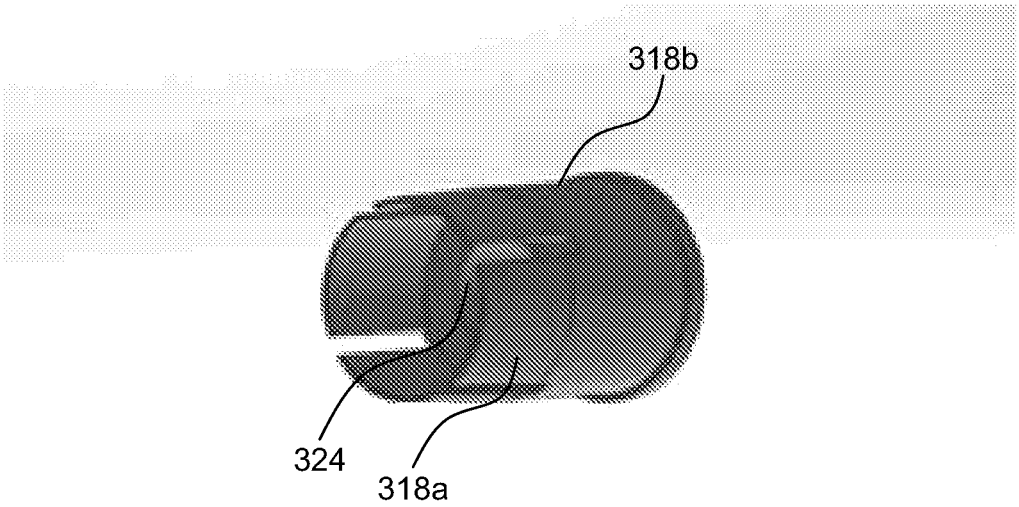

FIGS. 4*a* and 4*b* illustrate the installation process of the connector and the coaxial cable according to embodiments of the invention;

FIG. 5 shows the front end of the silicone sleeve according to an embodiment of the invention; and FIG. 6 shows an example of a fixing nut according to an embodiment of the invention.

DESCRIPTION OF EMBODIMENTS

Figure 1:
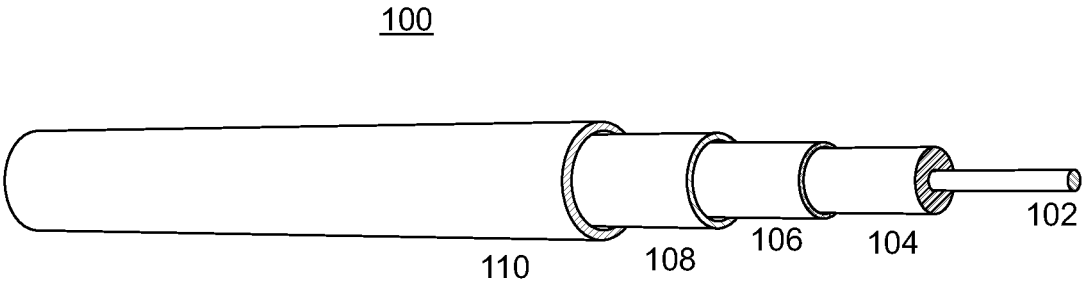

FIG. 1 shows an example of the structure of a coaxial cable. The cable 100 comprises an inner (or centre) conductor 102 for conducting electrical signals. The inner conductor 102 is typically made of copper or copper plated steel. The inner conductor 102 is surrounded by an insulating layer 104 forming a dielectric insulator around the conductor 102. The insulator surrounding the inner conductor may be solid plastic, such as polyethylene (PE) or Teflon (PTFE), a foam plastic, or air with spacers supporting the inner conductor.

The insulating layer 104 is surrounded by a thin metallic foil 106 typically made of aluminium. This is further surrounded by a woven metallic braid 108. FIG. 1 shows only one braid layer 108, but there may be two (inner and outer) layers of braid, or even more braid layers. Braiding is typically made of unalloyed aluminium, copper or tinned copper, depending on the intended field of use of the coaxial cable. For example, coaxial cables used in various TV assemblies typically have the braiding made of unalloyed aluminium. The cable is protected by an outer insulating jacket 110, typically made of polyvinylchloride (PVC).

The structure of the coaxial cable enables to minimize the leakage of electric and magnetic fields outside the braiding by confining the fields to the dielectric and to prevent outside electric and magnetic fields from causing interference to signals inside the cable. The shielding efficiency of each coaxial cable is characterized by its coupling transfer function, which may be defined as the transfer impedance and the screening attenuation measured together. The coupling transfer function is primarily dependent on the make-up of the coaxial cable, in part the outer and inner metal braiding and foil construction of the cable. However, for the practical use in various TV assemblies, the cable needs to be connected to the coaxial F connector.

There are two basic functional types of coaxial F type connectors currently available, i.e. crimp connectors and compression connectors. Both connector types include an outer body, a ferrule and a fixing nut. In order to make a ground connection between the cable braiding and connector, both of said connector types use a simple method of compressing the (outer) braid of the coaxial cable onto the connector ferrule. Both achieve the same outcome of connecting the coaxial cable to the connector by compression via the cable PVC outer jacket.

In order to achieve optimum transfer impedance, it is imperative that the metal-to-metal contact resistance between the connector and the cable braiding is optimised and maintained over time for good contact resistance. Any degradation in overall contact resistance will result in increasing the transfer impedance.

In light of the new 4G LTE™ wireless services, which operate within the CATV frequency spectrum, it has become imperative that cable interconnect assemblies, i.e. the coaxial cable with a connector attached, meet a very high screening effectiveness. For example, cable TV operators generally require the screening effectiveness to remain at −105 dB for the frequency range of 30-1000 MHz and the transfer impedance at 0.9 mΩ/m for 5-30 MHz, which are substantially in line with the CATV industry EN50117-2-4 Cenelec Standards as Class A++. Previous cable assemblies required only Class A+, i.e. −95 dB for 30-1000 MHz.

Figure 2:
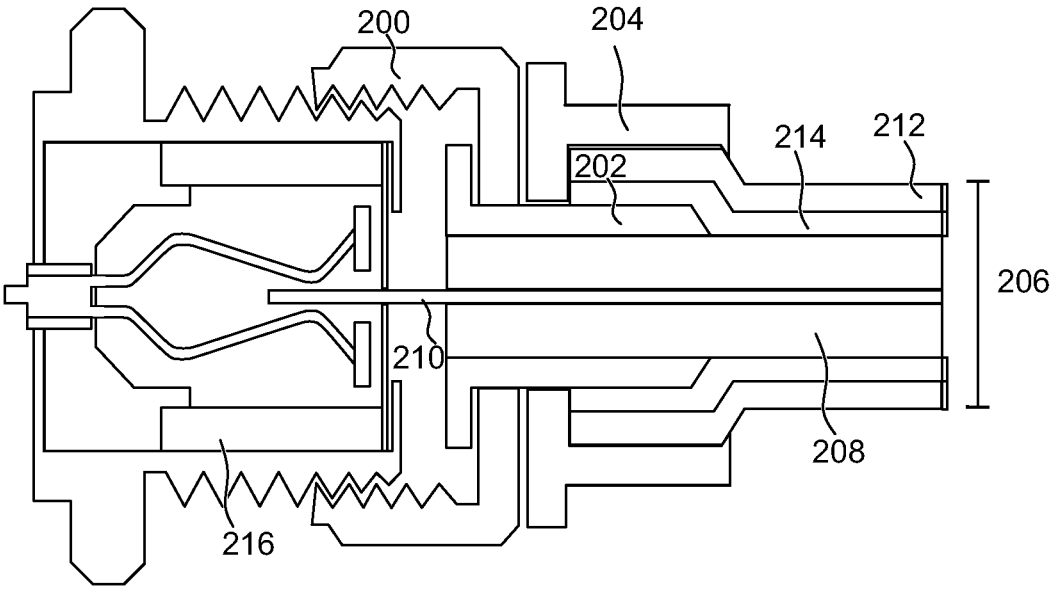
FIG. 2 shows a schematic cross-sectional view of a prior art F male compression connector with a coaxial cable connected to a F female connector.

FIG. 2 shows a schematic cross-sectional view of a prior art F male compression connector with a coaxial cable connected to an F female connector. The dimensions of various parts in FIG. 2 are not in scale. It is noted that the structure of the F female connector is not relevant for illustrating the underlying problems. The F male compression connector comprises the fixing nut 200, the ferrule 202 and the body 204. The F male compression connector is connected to the coaxial cable 206 such that the stripped dielectric insulator 208 and the inner conductor 210 of the coaxial cable are inserted in the ferrule 202 and the PVC jacket 212 of the cable is tightly compressed. The aluminium braiding 214 of the coaxial cable is in contact with the outer surface of the ferrule, thus providing ground connection. The body 204 of F male compression connector is connected to the F female connector 216 by screwing the fixing nut 200 to a corresponding thread in the body of the F female connector 216.

The problems arise from the fact that the ferrule 202 is typically NiSn plated and the braiding 214 of the coaxial cable is aluminium. The metal-to-metal contact points between the coaxial cable aluminium braid 214 and the NiSn plated connector ferrule 202 are the points at which said two parts mate to form the overall grounding point, but also the points which are subjected to galvanic corrosion due to above-described phenomena. Since the coaxial cable aluminium braid 214 and the NiSn plated connector ferrule 202 are not making an intimate metal-to-metal contact, an oxidising layer is developed, in this case due to dissimilar metals, as well as lack of contact pressure. The energy herein generates what is called the diode effect that in effect causes the nonlinear energy transfer (i.e. CPD) to occur.

Figure 3:
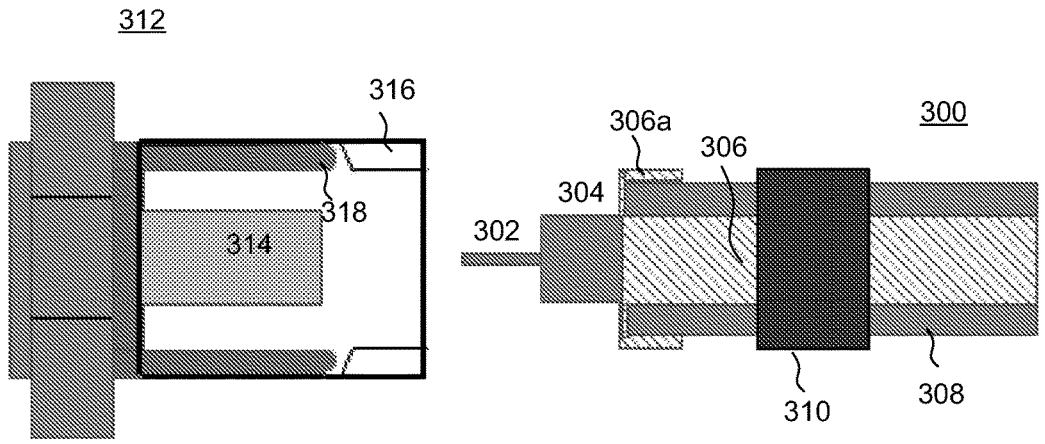
FIG. 3 illustrates a prior art mechanism for connecting the F male compression connector to the coaxial cable.

An example of the mechanism for connecting the F male compression connector to the coaxial cable as disclosed in WO 2017/098084 is further illustrated schematically in FIG. 3. The dimensions of various parts in FIG. 3 are not in scale. The coaxial cable 300 is shown on the right side before the cable insertion. The coaxial cable 300 comprises the centre conductor 302 and the dielectric insulator 304. The coaxial cable 300 further comprises the braiding 306 and the PVC jacket 308, which have been stripped away around the dielectric insulator 304 for the installation. A part **306*a* of the braiding 306 has been turned backwards over the PVC jacket 308. The silicone sleeve 310 has been arranged around the PVC jacket 308 of the coaxial cable 300** before connecting the coaxial cable to the connector. In many cases, it may be easier to connect the coaxial cable to the connector such that the silicone sleeve is pre-installed around the coaxial cable and coaxial cable is only then inserted in the connector.

A stand-alone F male compression connector 312 is shown on the left side as before the cable insertion. The connector comprises the ferrule 314, the outer body 316 of the fixing nut, and the inner body 318 of the fixing nut. The inner body 318 is typically made of plastic. The side of the outer body 316 facing the inner body is slanted such that when pushed against the inner body 318 upon the insertion of the coaxial cable 300, the inner body bends inside and compresses the silicone sleeve 310, which has been pushed over the braiding 306 in the area where the PVC jacket 308 has been stripped away. Upon pushing the silicone sleeve 310 to the area where the PVC jacket 308 has been stripped away, the silicone sleeve preferably pushes the part **306*a* of the braiding 306 back over the dielectric insulator 304. Thus, the pressure force of the silicone sleeve is applied on the braiding 306*a*, pressing it tightly against the ferrule 314**.

However, the installation of the silicone sleeve around the metal braid layer after removing an outer plastic jacket has faced some challenges. For example, for facilitating the installation of the connector in field by technicians, it would be helpful to pre-install the silicone sleeve around the coaxial cable, i.e. over the outer jacket of the cable. However, removing the outer jacket of cable upon installation reduces the diameter of the cable such that achieving sufficient pressure with a pre-installed sleeve may become difficult.

Now there has been invented a new arrangement for at least alleviating the above problems.

As the first aspect, there is provided a connector suitable for being mounted on a coaxial cable comprising at least one metal braid layer surrounding inner parts of the cable and an outer insulating layer surrounding said at least one metal braid layer and a silicone sleeve arranged around the outer insulating layer; wherein the connector comprises a ferrule to be arranged in electrical contact with said at least one metal braid layer, wherein said outer insulating layer of the cable is arranged to be stripped away for the length of said electrical contact, a base arranged cylindrically around said ferrule, and a collar arranged at least partially within said base and comprising a body configurable around the ferrule. The body of the collar has a first outer diameter substantially the same as the diameter of the outer insulating layer of the coaxial cable; and the silicone sleeve is arranged, upon mounting the coaxial cable to the connector, between the base and the body of the collar for applying a pressure force to said at least one metal braid layer of the coaxial cable guided to an outer surface of the body of the collar.

Thus, the problem of reduced diameter of the coaxial cable with stripped-off outer PVC layer is solved by introducing a new type of collar, where a body of the collar around the ferrule has an outer diameter substantially the same as the diameter of the outer insulating layer of the coaxial cable. Moreover, since the silicone sleeve is arranged, upon mounting the coaxial cable to the connector, e.g. by sliding between the base and the body of the collar, i.e. on the outer surface of the body, the silicone sleeve can be easily pushed around the body, since the outer diameters of body and the outer insulating layer of the coaxial cable are substantially the same. Now with the new type of collar, the pressure force of the silicone sleeve is arranged to said at least one metal braid layer of the coaxial cable guided on the body of the collar upon inserting the coaxial cable.

According to an embodiment, the first outer diameter of the body of the collar is substantially the same as the inner diameter of the silicone sleeve. Thus, the first outer diameter may be determined in terms of the inner diameter of the silicone sleeve, which may in some cases be different than the diameter of the outer insulating layer of the coaxial cable. Actually, for the purpose of fitting the silicone sleeve tightly over the contact area of the braiding and the ferrule, it is more relevant that first outer diameter is determined in terms of the inner diameter of the silicone sleeve.

According to an embodiment, the body of the collar has a second outer diameter larger than the diameter of the outer insulating layer of the coaxial cable. Thus, the position where the diameter of the body of the collar extends to the second diameter serves as a stop position for coaxial cable. The second thicker diameter ensures that the cable will be correctly assembled into the connector while preventing the cable to be pushed past the point.

Various embodiments of the arrangement are depicted in FIGS. 4*a* and 4*b*, which illustrate the installation process of the connector and the coaxial cable according to the arrangement. The same reference numbers as with FIG. 3 are used where applicable.

In FIG. 4*a*, the coaxial cable 300 is being inserted in the connector 312. For example, the insert 322 may be used for inserting the cable. The centre conductor 302 and the dielectric insulator 304 are being pushed into a cavity of the ferrule 314. The silicone sleeve 310 has been arranged around the PVC jacket 308. The base 316 is arranged cylindrically around the ferrule 314. The insert compresses the silicone sleeve 310 upon insertion, for example using tapers of the insert and the base 316 of the connector.

Now the connector 312 is provided with the new type of collar 320 arranged at least partially within the base 316. The collar 320 comprises a body 318 around the ferrule. The body 318 is a round-shaped elongated part locating co-axially with the ferrule, extending in two parts: the back part 318*b* having the thicker second diameter, and the front part 318*a* having the thinner first diameter. The outer diameters of front part 318*a* and the outer insulating layer 308 of the coaxial cable are advantageously substantially the same. As a result, the silicone sleeve 310 can be easily pushed from around the outer insulating layer 308 of the coaxial cable to around the front part 318*a* of the body 318. On the other hand, the outer diameter of back part 318*b* is larger than the outer diameter of the outer insulating layer 308, thereby preventing the cable to be pushed past the edge where the diameter extends.

According to an embodiment, a front end of the silicone sleeve is provided with an edge (or a lip) extending inwards. As shown in FIG. 3, part 306*a* of the braiding 306 has been turned backwards over the PVC jacket 308. FIG. 4*a* shows an edge 310*a*, which is arranged to fold back the part of the braiding to be inserted on the body 318 of the collar configured around the ferrule 314. While pushing the silicone sleeve over the front end of the cable may suffice to fold back the braiding, the edge 310*a* further enhances the effect.

FIG. 5 shows a magnification of the front end of the silicone sleeve, where the edge 310*a* is further illustrated. It can be seen that the edge acts like a brush ensuring that the braiding will be pushed back to its correct place.

FIG. 4*b* shows the coaxial cable 300 as correctly installed in the connector 312 according to an embodiment. The centre conductor 302 and the dielectric insulator (not shown) of the coaxial cable have been inserted in a cavity of the ferrule 314 such that the centre conductor 302 extends to the other side of connector so as to be connected to a female connector. The cable 300 has been inserted to be in contact with the edge of the back part 318*b* of the body of the collar, wherein the extended diameter prevents the cable to be pushed further.

The silicone sleeve 310 has been pushed to a position, where it covers substantially the outer surface of the body 318 of the collar. At the same time, the silicone sleeve 310 also covers a part of the coaxial cable 300, i.e. a distance from the front end of the cable, as shown in FIG. 4*b*. Upon insertion, the silicone sleeve 310 is pressed tightly between the base 316 and the body 318, there applying pressure force to the braiding (not shown) and further to the body 318. Thus, the silicone sleeve 310 enables to maintain the metal-to-metal contact resistance force between the braiding and the ferrule, thereby preventing the aluminium cable creep. On the other hand, the silicone sleeve seals the contact area of the braiding and the ferrule efficiently and prevents the oxidising of the aluminium braiding.

A second aspect relates to a collar for a ferrule of a coaxial cable connector, the fixing nut comprising a body configurable around the ferrule of the connector. The body of the collar has a first outer diameter substantially the same as the diameter of an outer insulating layer of the coaxial cable.

According to an embodiment, the body of the collar has a second outer diameter larger than the diameter of the outer insulating layer of the coaxial cable.

FIG. 6 shows an example of the collar. The collar is arranged to be placed with the base of the connector. The body 318 is a cylindrically-shaped elongated part arranged to be located co-axially around the ferrule. FIG. 6 shows the back part 318*b* of the body having the thicker second diameter, and the front part 318*a* of the body having the thinner first diameter. The outer diameter of front part 318*a* is substantially the same as the diameter of outer insulating layer of the coaxial cable. The outer diameter of back part 318*b* is larger than the outer diameter of the outer insulating layer 308, thereby stopping the cable to the position where the diameter extends. The collar comprises a hollow cavity 324 through which centre conductor and the dielectric insulator of the coaxial cable can be inserted.

It is noted that the idea underlying the embodiments is not limited to F type connectors only. Therefore, the collar as disclosed herein may applied in any type of connectors where a silicone sleeve is used to apply pressure force to the contact area of the braiding and the ferrule.

A skilled person appreciates that any of the embodiments described above may be implemented as a combination with one or more of the other embodiments, unless there is explicitly or implicitly stated that certain embodiments are only alternatives to each other.

It is obvious that the present invention is not limited solely to the above-presented embodiments, but it can be modified within the scope of the appended claims.

The invention claimed is:

1. An assembly comprising a coaxial cable and a connector suitable for being mounted on the coaxial cable comprising at least one metal braid layer surrounding inner parts of the cable and an outer insulating layer surrounding said at least one metal braid layer and a silicone sleeve arranged around the outer insulating layer; wherein the connector comprises a ferrule to be arranged in electrical contact with said at least one metal braid layer, wherein said outer insulating layer of the cable is arranged to be stripped away for the length of said electrical contact, a base arranged cylindrically around said ferrule, and a collar arranged at least partially within said base and comprising a body configurable around the ferrule, wherein the body of the collar has a first outer diameter substantially the same as the diameter of the outer insulating layer of the coaxial cable; and wherein the silicone sleeve is arranged, upon mounting the coaxial cable to the connector, between the base and the body of the collar, the silicone sleeve being arranged to apply a pressure force to said at least one metal braid layer of the coaxial cable, the pressure force guiding said at least one metal braid layer to an outer surface of the collar, wherein a front end of the silicone sleeve is provided with an edge extending inside the silicone sleeve.

2. The assembly according to claim 1, wherein the body of the collar has a second outer diameter larger than the diameter of the outer insulating layer of the coaxial cable.

3. The assembly according to claim 1, wherein the edge extending inside the silicone sleeve brushes the at least one metal braid layer into place on the outer surface of the collar.

4. The assembly according to claim 1, wherein the silicone sleeve is arranged within said connector in a position co-locating with the contact area of the braiding and the ferrule.

5. The assembly according to claim 4, wherein the silicone sleeve is arranged within said connector in a position where the silicone sleeve also covers a part of the coaxial cable.

* * * * *